US012779296B2

(12) United States Patent
Cameron et al.

(10) Patent No.: US 12,779,296 B2
(45) Date of Patent: Nov. 3, 2026

(54) PUTTER WITH IMPROVED CONSTRUCTION AND ALIGNMENT

(71) Applicant: Acushnet Company, Fairhaven, MA (US)

(72) Inventors: Don T. Cameron, Carlsbad, CA (US); Augustin W. Rollinson, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 332 days.

(21) Appl. No.: 18/535,355

(22) Filed: Dec. 11, 2023

(65) Prior Publication Data

US 2025/0050180 A1 Feb. 13, 2025

Related U.S. Application Data

(63) Continuation-in-part of application No. 18/446,374, filed on Aug. 8, 2023, now Pat. No. 12,434,116.

(51) Int. Cl.
*A63B 53/04* (2015.01)
*A63B 53/00* (2015.01)

(52) U.S. Cl.
CPC ..... *A63B 53/0487* (2013.01); *A63B 53/0441* (2020.08); *A63B 53/007* (2013.01); *A63B 53/0408* (2020.08); *A63B 2053/0491* (2013.01)

(58) Field of Classification Search
CPC ..... A63B 53/0441; A63B 53/0487
See application file for complete search history.

(56) References Cited

U.S. PATENT DOCUMENTS

| | | | | |
|---|---|---|---|---|
| 1,618,638 A | | 2/1927 | Coles | |
| D222,280 S | | 10/1971 | Cook | |
| 3,680,860 A | * | 8/1972 | Elkins, Jr. | A63B 69/3614 473/409 |
| 3,826,495 A | * | 7/1974 | Elkins, Jr. | A63B 53/0487 473/409 |
| 3,841,640 A | | 10/1974 | Hunter | |
| 3,880,430 A | | 4/1975 | Mccabe | |
| 3,888,492 A | | 6/1975 | Cabot | |
| D235,668 S | | 7/1975 | Swash | |
| 3,921,984 A | * | 11/1975 | Winter | A63B 53/0487 473/251 |
| 3,931,975 A | | 1/1976 | Cook | |
| 3,954,270 A | | 5/1976 | Cook | |
| 3,966,210 A | | 6/1976 | Rozmus | |
| 4,002,343 A | | 1/1977 | Eckert | |

(Continued)

FOREIGN PATENT DOCUMENTS

| | | |
|---|---|---|
| JP | 3052104 U | 9/1998 |
| JP | H1189981 A | 4/1999 |

(Continued)

OTHER PUBLICATIONS

Final Office Action dated Nov. 9, 2016 issued in U.S. Appl. No. 14/253,041.

(Continued)

*Primary Examiner* — Alvin A Hunter
(74) *Attorney, Agent, or Firm* — Ryan A. Reis

(57) ABSTRACT

A putter having angled surfaces, sightlines, contrasting colors, and varying depths for aiding with alignment. The putter having multiple components making up the body and utilizing multiple materials.

18 Claims, 5 Drawing Sheets

(56) References Cited

U.S. PATENT DOCUMENTS 4,043,562 A 8/1977 Shillington
4,113,249 A 9/1978 Beery
4,128,244 A 12/1978 Duclos
4,136,877 A 1/1979 Antonious
4,140,318 A 2/1979 Izett et al.
4,163,554 A 8/1979 Bernhardt
4,227,694 A 10/1980 Drake
4,231,576 A 11/1980 Perkins
4,265,451 A 5/1981 Bernhardt
4,411,429 A 10/1983 Drew et al.
4,458,900 A 7/1984 Antonious
4,712,797 A 12/1987 Kovalchek
4,722,528 A 2/1988 Tsao
4,934,702 A 6/1990 Serizawa
4,986,544 A 1/1991 Benson
5,324,031 A 6/1994 Green
5,351,963 A 10/1994 Baek
5,407,194 A 4/1995 Snow
5,417,429 A * 5/1995 Strand ..... A63B 69/3685 473/251
5,464,215 A 11/1995 Koehler
5,464,218 A 11/1995 Schmidt et al.
5,470,070 A 11/1995 Bendo
5,494,282 A 2/1996 Pranio
5,501,453 A 3/1996 Hurst
5,628,694 A 5/1997 O'Connor, Jr.
5,630,765 A 5/1997 Moore
5,683,307 A 11/1997 Rife
5,749,791 A 5/1998 Passeri, Jr.
5,816,930 A 10/1998 Brown
5,820,481 A 10/1998 Raudman
5,890,969 A 4/1999 Bechler
5,911,638 A 6/1999 Parente et al.
5,913,731 A 6/1999 Westerman
5,921,868 A 7/1999 Dimartino
6,048,275 A 4/2000 Gedeon
6,062,986 A 5/2000 Kaise
6,080,070 A 6/2000 Whitley
6,117,020 A 9/2000 Currie
6,261,190 B1 7/2001 Ashcraft
6,270,422 B1 8/2001 Fisher
6,319,146 B1 11/2001 Mills
6,350,208 B1 2/2002 Ford
6,558,268 B2 5/2003 Tindale
6,652,390 B2 * 11/2003 Bradford ..... A63B 53/0487 473/340
6,796,911 B2 9/2004 Grace
6,837,801 B1 1/2005 Serrano et al.
6,878,072 B1 4/2005 Henry
6,896,625 B2 * 5/2005 Grace ..... A63B 60/02 473/340
6,902,496 B2 6/2005 Schweigert et al.
6,926,615 B1 8/2005 Jones et al.
6,958,019 B2 * 10/2005 Rohrer ..... A63B 60/02 473/251
6,960,140 B2 11/2005 Jones et al.
7,004,849 B2 2/2006 Cameron
D521,582 S 5/2006 Jones et al.
7,048,646 B2 5/2006 Yamanaka et al.
7,052,409 B2 5/2006 Goldsmith
7,077,758 B2 7/2006 Rohrer
7,121,954 B2 10/2006 Charron
7,147,569 B2 12/2006 Rollinson et al.
7,163,469 B2 1/2007 Bonneau
7,166,039 B2 1/2007 Hettinger et al.
D540,897 S 4/2007 Franklin et al.
7,235,021 B2 6/2007 Jones et al.
7,335,112 B1 * 2/2008 Bitondo ..... A63B 60/52 473/238
D564,606 S 3/2008 Franklin et al.
7,344,451 B2 3/2008 Rollinson et al.
7,371,184 B2 5/2008 Tao
7,374,497 B2 5/2008 Brown
7,407,443 B2 8/2008 Tavares et al.
7,431,663 B2 * 10/2008 Pamias ..... A63B 53/02 473/307
7,438,648 B2 * 10/2008 Wahl ..... A63B 53/0487 473/340
7,448,963 B2 11/2008 Wright et al.
7,455,599 B2 11/2008 Jones
7,491,131 B2 2/2009 Vinton
7,578,752 B1 8/2009 Flores
7,588,499 B2 9/2009 Tateno
7,611,419 B2 11/2009 O'Neill
D607,950 S 1/2010 Fife et al.
7,789,764 B2 9/2010 Wilson et al.
7,815,515 B1 10/2010 Hunt
7,824,275 B2 11/2010 Sussich
7,833,108 B2 11/2010 Hosowich
7,918,745 B2 4/2011 Soracco et al.
7,922,596 B2 4/2011 Vanderbilt et al.
7,927,226 B1 4/2011 Twitty
7,959,519 B2 6/2011 Zielke et al.
8,100,779 B2 1/2012 Sanchez et al.
8,128,505 B2 3/2012 Tryner et al.
8,216,082 B2 * 7/2012 Ines ..... A63B 53/007 473/340
8,303,434 B1 * 11/2012 DePaul ..... A63B 53/0487 473/341
8,308,583 B2 11/2012 Soracco et al.
8,328,654 B2 12/2012 Miraflor et al.
8,348,781 B2 * 1/2013 Ines ..... A63B 53/0487 473/340
8,371,958 B2 2/2013 Treadwell
8,382,605 B2 2/2013 Treadwell
8,480,504 B2 7/2013 Hilton et al.
8,523,698 B2 9/2013 Hotaling et al.
8,632,415 B1 1/2014 Smith
8,932,144 B2 1/2015 Simizu
D730,464 S 5/2015 Cameron
9,144,717 B2 * 9/2015 Franklin ..... A63B 53/0487
9,220,960 B2 12/2015 Schartiger
9,227,115 B2 1/2016 Cameron
9,248,352 B1 2/2016 Patten
9,604,108 B1 * 3/2017 Dunnell ..... A63B 60/02
9,623,301 B2 * 4/2017 Bamber ..... A63B 53/007
9,717,961 B2 8/2017 Cameron
9,943,733 B2 * 4/2018 Franklin ..... A63B 53/04
9,987,531 B2 6/2018 Cameron
10,124,220 B2 11/2018 Cameron
10,279,228 B2 * 5/2019 Smith ..... A63B 53/14
10,363,464 B2 7/2019 Cameron
10,583,344 B2 * 3/2020 Hilton ..... A63B 53/065
11,298,597 B2 * 4/2022 Parsons ..... A63B 53/065
D959,581 S 8/2022 Parsons et al.
11,707,656 B2 * 7/2023 Scott ..... A63B 53/0487 473/340
D1,065,395 S * 3/2025 Toulon ..... D21/698
2002/0103038 A1 * 8/2002 Farmer ..... A63B 53/0487 473/251
2003/0144075 A1 * 7/2003 Cullen ..... A63B 53/0487 473/340
2003/0228925 A1 * 12/2003 Rohrer ..... A63B 60/02 473/340
2004/0209702 A1 10/2004 Charron et al.
2005/0137027 A1 6/2005 Thomas
2005/0239574 A1 * 10/2005 Rohrer ..... A63B 60/02 473/340
2006/0014590 A1 * 1/2006 Tao ..... A63B 53/0487 473/340
2006/0148585 A1 * 7/2006 Vinton ..... A63B 53/0487 473/340
2006/0258475 A1 11/2006 Lee
2007/0004525 A1 * 1/2007 Lee ..... A63B 60/52 473/242
2007/0105652 A1 5/2007 Wright et al.
2007/0191135 A1 * 8/2007 Nilsson ..... A63B 53/0487 473/340
2007/0298904 A1 12/2007 Dworzan
2008/0108450 A1 * 5/2008 Bamber ..... A63B 53/0487 473/341

(56) References Cited

U.S. PATENT DOCUMENTS

| | | | | |
|---|---|---|---|---|
| 2008/0153623 | A1* | 6/2008 | Ines | A63B 53/0487 473/340 |
| 2011/0275453 | A1* | 11/2011 | Tavares | A63B 53/04 473/340 |
| 2013/0123042 | A1* | 5/2013 | Ines | A63B 53/0487 473/340 |
| 2013/0157774 | A1 | 6/2013 | Chen | |
| 2013/0203522 | A1* | 8/2013 | Franklin | A63B 53/007 473/341 |
| 2013/0237341 | A1* | 9/2013 | Smith | A63B 60/22 473/313 |
| 2015/0011329 | A1* | 1/2015 | Cohen | A63B 60/02 473/340 |
| 2015/0080147 | A1 | 3/2015 | Cameron | |
| 2015/0080148 | A1 | 3/2015 | Cameron | |
| 2017/0216689 | A1* | 8/2017 | Bamber | A63B 53/007 |
| 2017/0282028 | A1* | 10/2017 | Sheldon | A63B 53/0487 |
| 2019/0240557 | A1* | 8/2019 | Hilton | A63B 69/3685 |
| 2020/0197780 | A1* | 6/2020 | Hilton | A63B 69/3685 |
| 2021/0402267 | A1* | 12/2021 | Parsons | A63B 53/0416 |

FOREIGN PATENT DOCUMENTS

| | | | |
|---|---|---|---|
| JP | 2005046442 | A | 2/2005 |
| JP | 2005518885 | A | 6/2005 |
| JP | 2006247320 | A | 9/2006 |
| JP | 2006326216 | A | 12/2006 |
| JP | 2007029648 | A | 2/2007 |
| JP | 2008132197 | A | 6/2008 |
| JP | 2010284434 | A | 12/2010 |
| JP | 2018510712 | A | 4/2018 |
| WO | 2022140592 | A1 | 6/2022 |
| WO | 2023220255 | A1 | 11/2023 |

OTHER PUBLICATIONS

European Search Report issued in EP application No. 24193713.5, dated Dec. 12, 2024 in 9 pages.

* cited by examiner

PUTTER WITH IMPROVED CONSTRUCTION AND ALIGNMENT

CROSS-REFERENCE TO RELATED APPLICATIONS

This application is a continuation-in-part of U.S. patent application Ser. No. 18/446,374, filed on Aug. 8, 2023, which is hereby incorporated by reference in its entirety.

FIELD OF THE INVENTION

The present invention relates to a golf club, and, more particularly, the present invention relates to a golf putter having a body made from at least three separate components and sightlines formed on multiple components.

DESCRIPTION OF THE RELATED ART

Golf club heads come in many different forms and makes, such as metal-woods, irons (including wedges), utility- or hybrid- or specialty-type clubs, and putters. Each of these styles has a prescribed function and general construction. The present invention primarily relates to putters, which typically are used to strike a golf ball and impart a rolling path on the greens of a course.

There are many styles of putters that provide different advantages. Putters are also governed by the rules of golf set by the USGA. The rules include the heel-toe dimension, the front-to-back dimension, the neck length, the face angle, the lie angle and that the putter shall not be substantially different from the customary and traditional form.

SUMMARY OF THE INVENTION

In some aspects, the techniques described herein relate to a putter including: a first body member including a striking face and a rear portion extending rearward from the striking face in an address position; a second body member coupled to the first body member below the rear portion of the first body member and rearward of the striking face in the address position; a third body member coupled to the second body member below the second body member in the address position; and a face center plane that passes through a face center of the striking face and is perpendicular to a ground plane in the address position, wherein the first body member, the second body member, and the third body member are visible to a golfer in the address position.

In some aspects, the techniques described herein relate to a putter including: a first body member including a striking face and a rear portion extending rearward from the striking face in an address position; a second body member coupled to the first body member below the rear portion of the first body member and rearward of the striking face in the address position; a third body member coupled to the second body member below the second body member in the address position; and a face center plane that passes through a face center of the striking face and is perpendicular to a ground plane in the address position, wherein the first body member is made from a first material having a first density, wherein the second body member is made from a second material having a second density, wherein the third body member is made from a third material having a third density, wherein the second density is less than the first density, wherein the second density is less than the third density, wherein the first body member includes at least one sightline, and wherein the second body member includes a plurality of sightlines.

In some aspects, the techniques described herein relate to a putter including: a first body member including a striking face and a rear portion extending rearward from the striking face; and a face center plane which passes through a face center of the striking face and is perpendicular to a ground plane in an address position, wherein the first body member includes a first angled surface toeward of the face center plane having an angle between 20 degrees and 60 degrees relative to the face center plane.

In some aspects, the techniques described herein relate to a putter including: a first body member including a striking face and a rear portion extending rearward from the striking face; and a face center plane which passes through a face center of the striking face and is perpendicular to a ground plane in an address position, wherein the first body member includes an angled toe surface having an angle relative to the face center plane, and wherein a plane extending along the angled toe surface intersects the face center plane a distance between 3 inches and 30 inches forward of the striking face.

BRIEF DESCRIPTION OF THE DRAWINGS

The present invention is described with reference to the accompanying drawings, in which like reference characters reference like elements, and wherein.

DETAILED DESCRIPTION OF THE INVENTION

Figure 1:
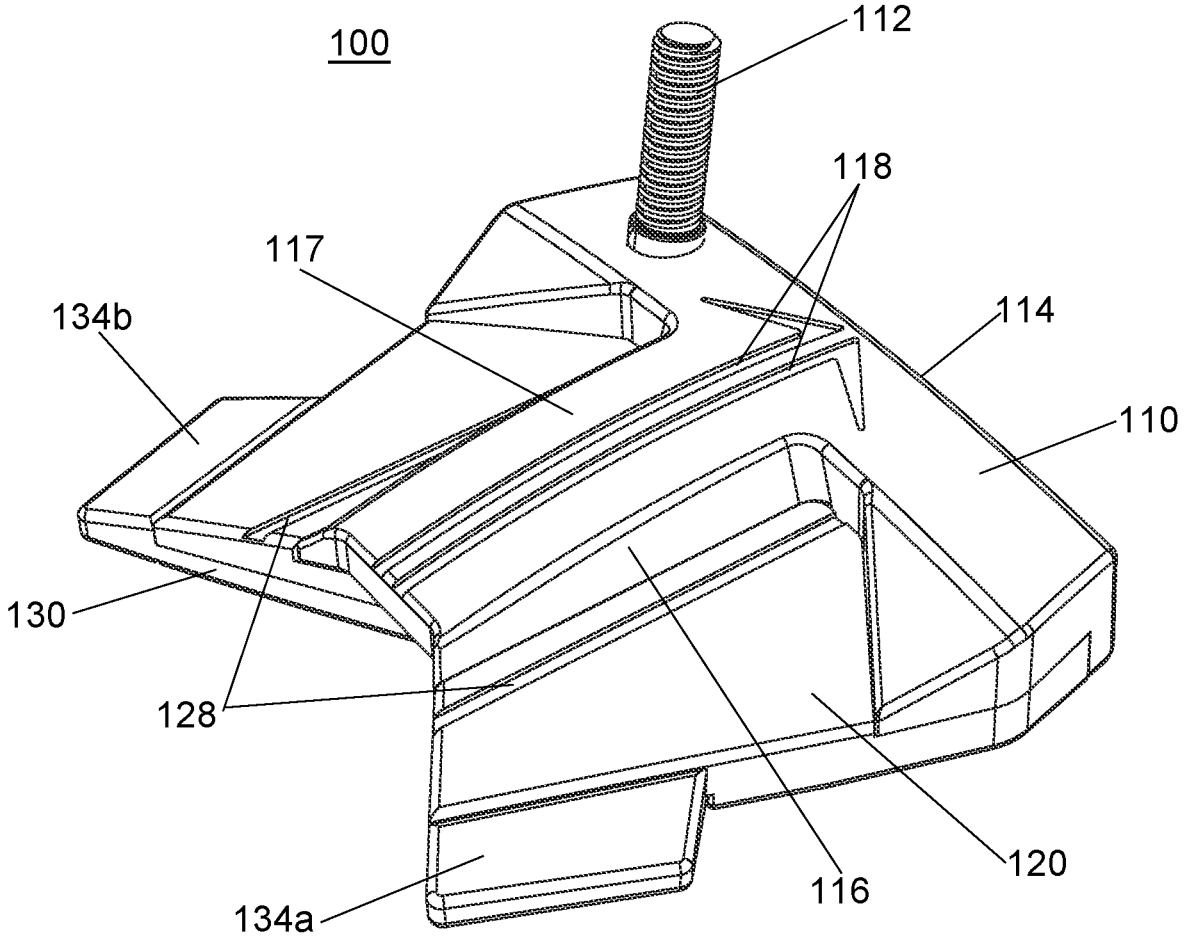
FIG. 1 shows a top perspective view of a putter of the present invention.
Figure 2:
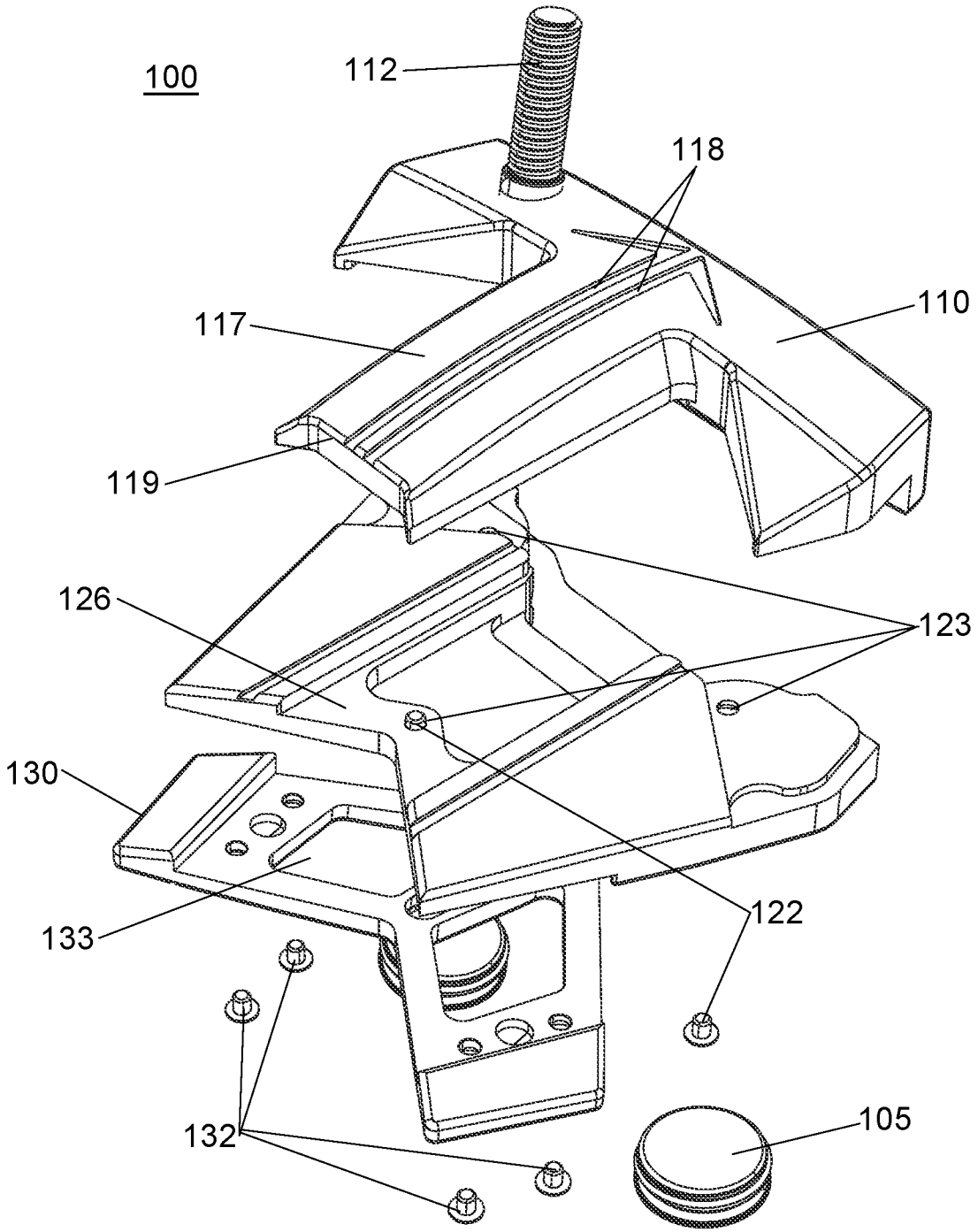
FIG. 2 shows an exploded top perspective view of the putter of FIG. 1.
Figure 3:
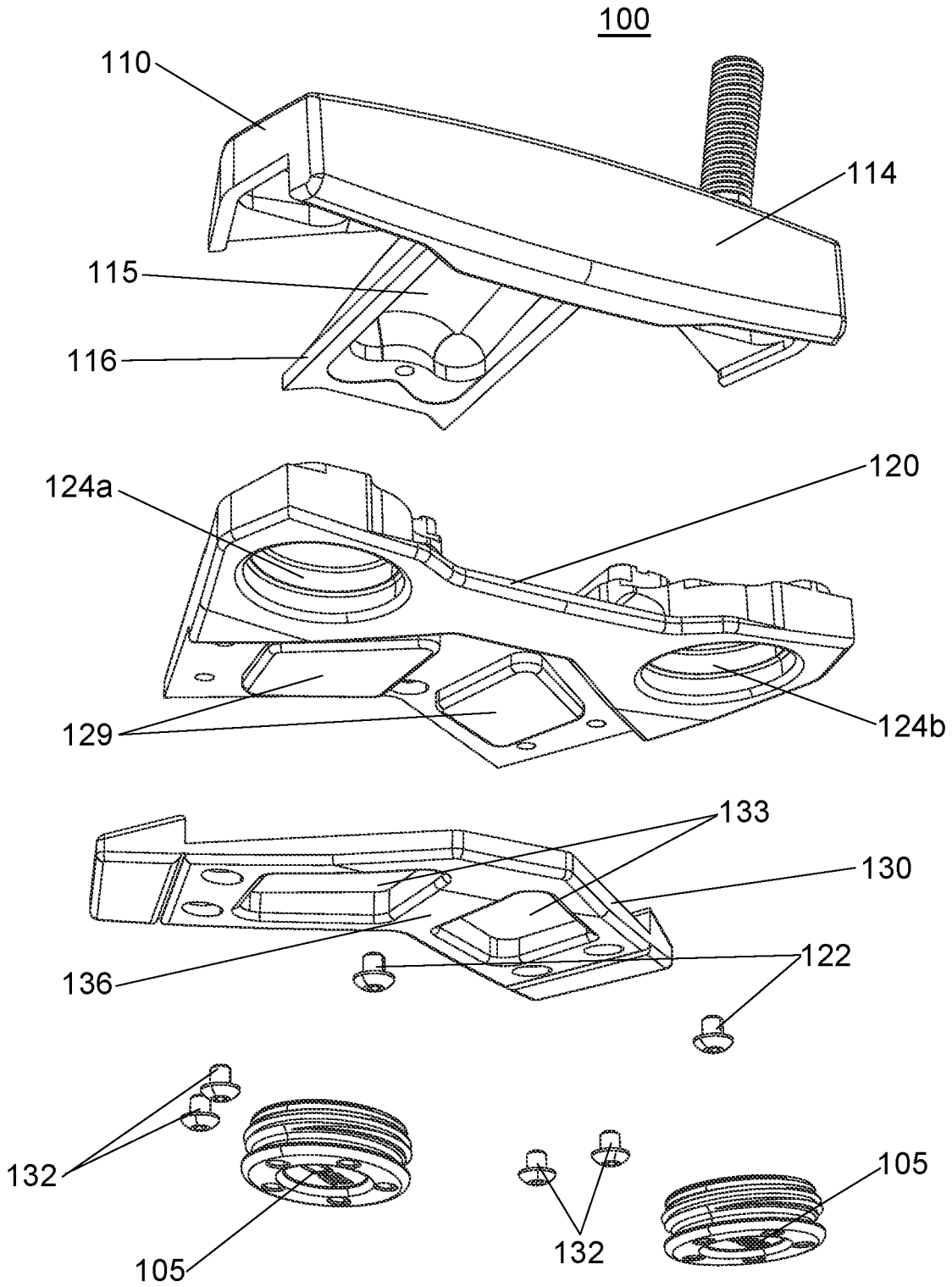
FIG. 3 shows an exploded bottom perspective view of the putter of FIG. 1.
Figure 4:
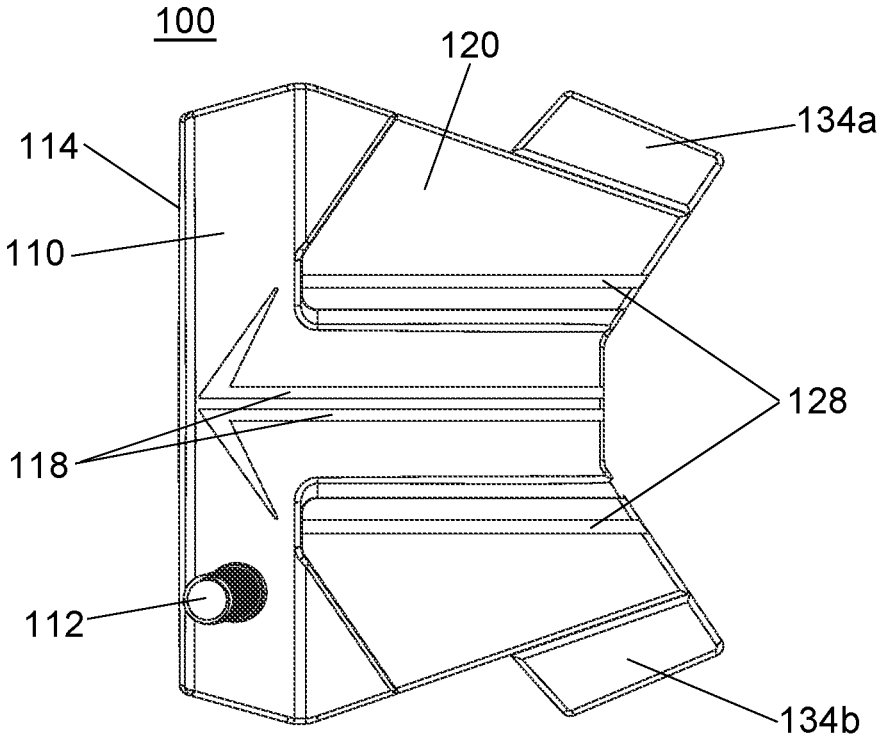
FIG. 4 shows a top view of the putter of FIG. 1.
Figure 5:
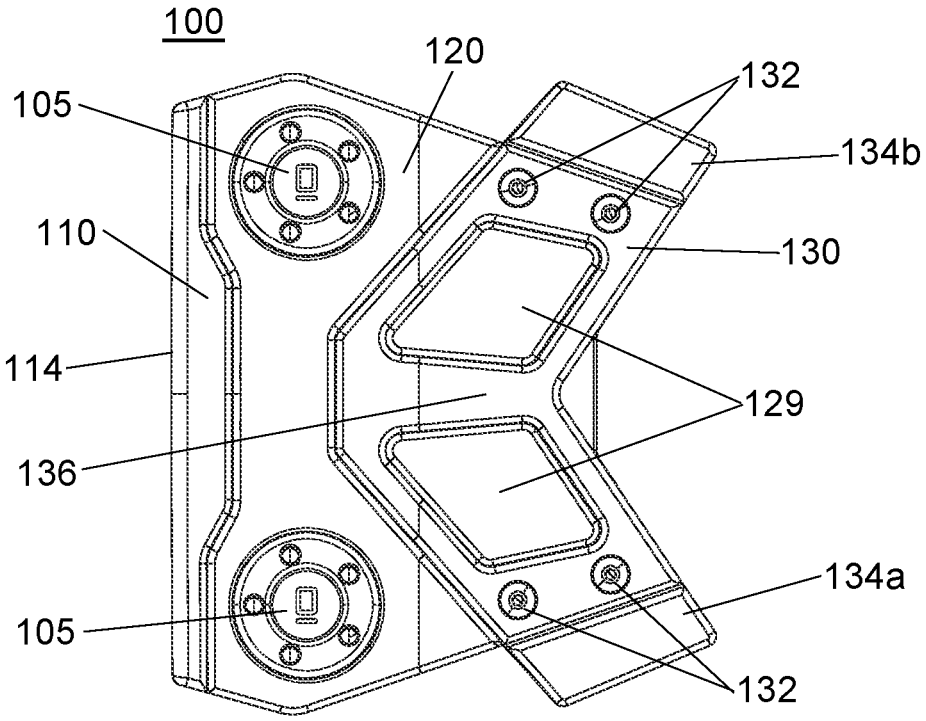
FIG. 5 shows a bottom view of the putter of FIG. 1.

Referring to FIGS. 1-6, the present invention is directed to a putter 100. The putter 100 includes a first body member 110, a second body member 120, and a third body member 130. Constructing the putter 100 with the first body member 110, the second body member 120, and the third body member 130, as described in greater detail below, allows for greater weight distribution in the putter 100 for improved sound, feel, and forgiveness and creates a contrast between body members which improves a golfer's ability to align the putter 100 towards an intended target. The first body member 110 includes a striking face 114 for impacting the golf ball during the putting stroke. The first body member 110 in this embodiment includes a hosel 112 that is coupled to a shaft and grip as is well known in the art. The first body member 110 includes a rear portion 116 extending rearward from the striking face 114 having an upper surface 117 that can be seen by the golfer in the address position. The rear portion 116 may include a cavity 115 to allow weight to be distributed to other areas of the putter 100.

The first body member 110 also includes at least one sightline 118 on the upper surface 117 of the rear portion 116 that extends rearwardly from the striking face 114. The at least one sightline 118 may extend from the striking face 114 to a rearmost edge 119 of the first body member 110 to provide a maximum length for the at least one sightline 118 and further aid the golfer in proper alignment of the putter 100. The at least one sightline 118 may be formed as a groove, a protrusion, or a painted line on the upper surface 117. The at least one sightline 118 may be in the shape of an arrow to assist the golfer in aligning the putter 100 towards the target. In a preferred embodiment, the first body member 110 is one color such as grey or black and the at least one sightline 118 is a different, contrasting color. For example, if first body member 110 is black, the at least one sightline 118 may be red, white, silver or other bright color. If the first body member 110 is grey, the at least one sightline 118 may be red, white, black or other contrasting color. In a preferred embodiment, a golfer may select a color of the at least one sightline 118 in order to personalize the putter 100. The first body member 110 is made of a first material having a first density. In the most preferred embodiment, the first body member 110 is formed of steel and has a density of about 7 g/cc to 8 g/cc.

The putter 100 includes the second body member 120 that is coupled to the first body member 110 via fasteners 122. The second body member 120 is located below the first body member 110 and rearward of the striking face 114 in the address position. The second body member 120 includes a first weight port 124*a* located on a toe side of a face center plane 140 that passes through a face center of the striking face 114 and is perpendicular to the ground plane at the address position. The second body member 120 also includes a second weight port 124*b* located on a heel side of the face center plane 140. Fasteners 122 may be inserted through apertures 123 located in the first weight port 124*a* and the second weight port 124*b* to couple the second body member 120 to the first body member 110. The putter 100 includes weight members 105 which may be removably inserted into the first weight port 124*a* and the second weight port 124*b*. Preferably, the weight members 105 are formed of steel or tungsten. The weight members 105 may each be formed to weigh between 10 grams and 50 grams. The weight members 105 may be located equidistant from the face center plane 140 to increase the moment of inertia of the putter 100. The weight members 105 may be threaded and act as covers to protect the fasteners 122 from corrosion and wear as well as unwanted disassembly of the second body member 120 from the first body member 110. The second body member 120 may include a central groove 126 that receives the rear portion 116 of the first body member 110 when assembled. The central groove 126 acts as a locating feature to assist in proper alignment of the first body member 110 with the second body member 120 during assembly. The central groove 126 may include at least one aperture 123 that receives at least one of the fasteners 122 to couple the second body member 120 to the first body member 110.

The second body member 120 includes sightlines 128 located on either side of the central groove 126 on a top surface of the second body member 120 such that the sightlines 128 are visible to the golfer in the address position. The sightlines 128 may be formed as grooves, protrusions, or painted lines on the second body member 120. In a preferred embodiment, the second body member 120 is one color such as grey or black and the sightlines 128 are a different, contrasting color. For example, if second body member 120 is black, the sightlines 128 may be red, white, silver or other bright color. If the second body member 120 is grey, the sightlines 128 may be red, white, black or other contrasting color. In a preferred embodiment, a golfer may select a color of the sightlines 128 in order to personalize the putter 100. The sightlines 128 are parallel to each other and are positioned to extend perpendicular to the striking face 114. Preferably, the sightlines 128 are spaced apart by greater than 1.0 inch. In another preferred embodiment, the sightlines 128 are spaced apart by about 1.6 inches to correspond to the width of a golf ball. The sightlines 128 are preferably equally spaced about the face center plane 140. The sightlines 128 may be located a distance greater than 0.1 inches below the upper surface 117 of the first body member 110 in a direction perpendicular to the ground plane at the address position. The second body member 120 is preferably made of a color different than the color of the first body member 110. The contrasting colors of the first body member 110 and the second body member 120 provides greater visual alignment of the putter 100. The second body member 120 is made of a second material having a second density which is less than the density of the first material of the first body member 110. In the most preferred embodiment, the second body member 120 is formed of aluminum having a density of about 2.5 g/cc to 3 g/cc.

The putter 100 also includes the third body member 130 that is coupled to the second body member 120 via fasteners 132. The third body member 130 may include at least one aperture 133 which receives at least one projection 129 located on a bottom surface of the second body member 120 when assembled. The at least one aperture 133 acts as a locating feature to assist in proper alignment of the second body member 120 with the third body member 130 during assembly. The at least one aperture 133 also allows weight to be distributed to other areas of the putter 100 for improved sound, feel, and forgiveness. The third body member 130 includes a first projection 134*a* located on a toe side of the face center plane 140 and a second projection 134*b* located on a heel side of the face center plane 140. The first projection 134*a* and the second projection 134*b* distribute weight in toeward and heelward directions to increase the moment of inertia and forgiveness of the putter 100. The first projection 134*a* and the second projection 134*b* are visible to the golfer at the address position to further provide contrast for improved visual alignment. The third body member 130 may include a central portion 136 which acts as a cover to protect at least one of the fasteners 122 from corrosion and wear as well as unwanted disassembly of the second body member 120 from the first body member 110. The third body member 130 may be positioned rearward of the first weight port 124*a* and the second weight port 124*b* of the second body member 120. The third body member 130 is preferably made of a color different than the color of the second body member 120. The third body member 130 is preferably made of the same color as the first body member 110. The contrasting colors between the first body member 110 and the second body member 120 and the contrasting colors between the second body member 120 and the third body member 130 provides greater visibility when aligning the putter 100. The third body member 130 is made of a third material having a third density. In the most preferred embodiment, the third body member 130 is formed of steel and has a density of about 7 g/cc to 8 g/cc. The multiple body member construction described above provides more targeted weight distribution in the putter 100 for more forgiveness and improved sound and feel while also providing a greater degree of contrasting depths and colors to enhance the visual alignment of the putter 100 towards a target. Features described above also aid in proper assembly and protection of components from wear and unwanted disassembly.

Figure 6:
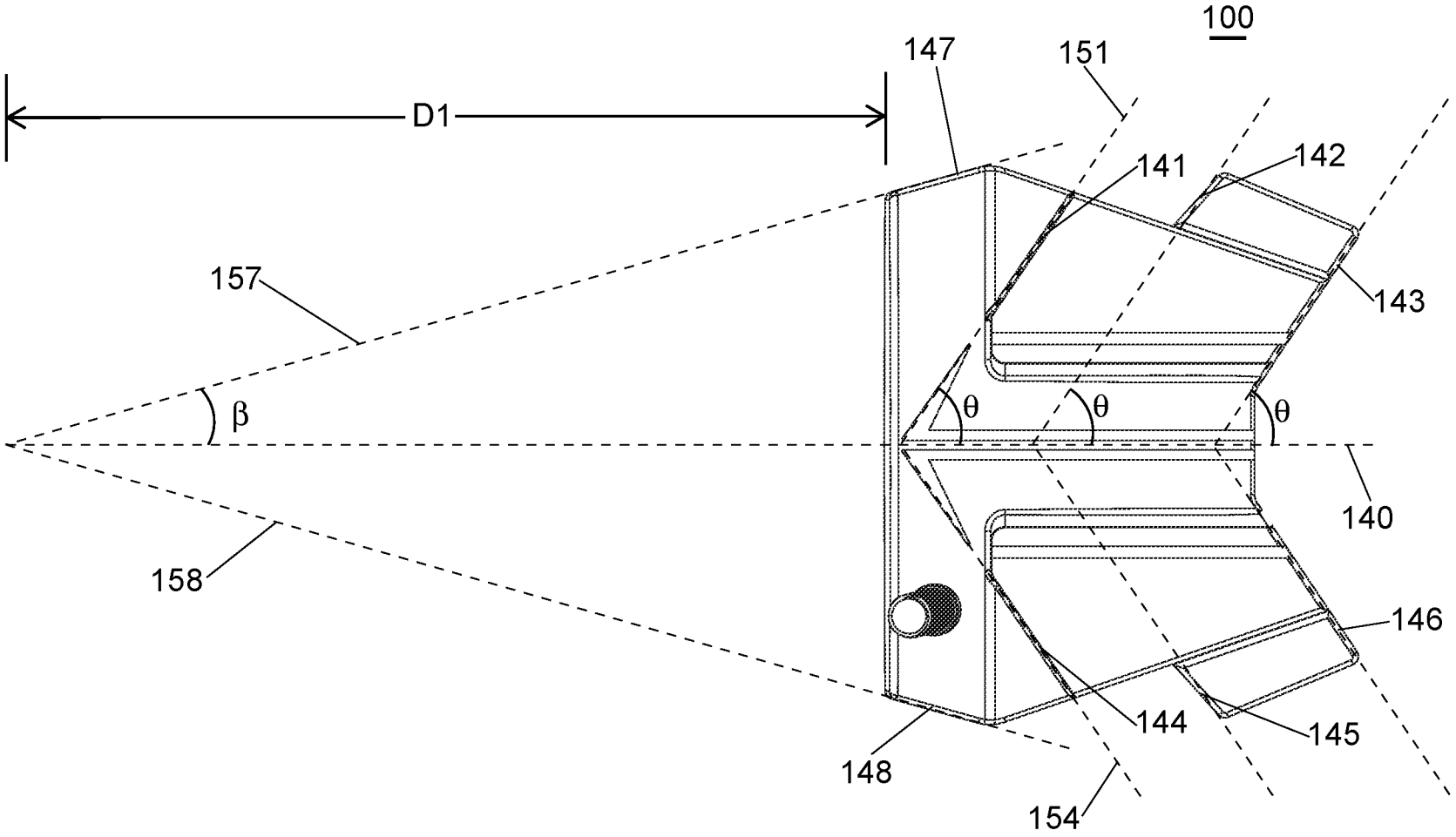
FIG. 6 shows a top view of the putter of FIG. 1.

As shown in FIG. 6, the putter 100 includes several alignment features to aid a golfer in orienting the putter 100 towards a target. In a top plan view of the putter 100 at normal address position; the putter 100 may include a first angled surface 141 toward of the face center plane 140 on the first body member 110 forming an angle θ with respect to the face center plane 140, a second angled surface 142 toeward of the face center plane 140 on the third body member 130 forming an angle θ with respect to the face center plane 140, and a third angled surface 143 toeward of the face center plane 140 on the third body member 130 forming an angle θ with respect to the face center plane 140. The putter 100 may include a fourth angled surface 144 heelward of the face center plane 140 on the first body member 110 forming an angle θ with respect to the face center plane 140, a fifth angled surface 145 heelward of the face center plane 140 on the third body member 130 forming an angle θ with respect to the face center plane 140, and a sixth angled surface 146 heelward of the face center plane 140 on the third body member 130 forming an angle θ with respect to the face center plane 140. In a preferred embodiment, the angle θ is the same for the first angled surface 141, the second angled surface 142, the third angled surface 143, the fourth angled surface 144, the fifth angled surface 145, and the sixth angled surface 146. Preferably, the angle θ is between 20 degrees and 60 degrees, more preferably the angle θ is between 25 degrees and 50 degrees, and most preferably the angle θ is between 30 degrees and 40 degrees. The first angled surface 141 may be symmetrical with the fourth angled surface 144 about the face center plane 140, the second angled surface 142 may be symmetrical with the fifth angled surface 145 about the face center plane 140, and the third angled surface 143 may be symmetrical with the sixth angled surface 146 about the face center plane 140. A plane 151 extending along the first angled surface 141 intersects the striking face 114 within +/−0.5 inches of the face center in a heel-to-toe direction and more preferably within +/−0.25 inches of the face center in the heel-to-toc direction. A plane 154 extending along the fourth angled surface 144 intersects the striking face 114 within +/−0.5 inches of the face center in a heel-to-toe direction and more preferably within +/−0.25 inches of the face center in the heel-to-toe direction. The first angled surface 141, the second angled surface 142, the third angled surface 143, the fourth angled surface 144, the fifth angled surface 145, and the sixth angled surface 146 all act to direct a golfer's eyes toward the face center plane 140 for more accurate positioning of a golf ball at the face center and for more accurate alignment of the putter 100 toward an intended target.

The putter 100 may include an angled toe surface 147 on the first body member 110 forming an angle β with respect to the face center plane 140 and an angled heel surface 148 on the first body member 110 forming an angle β with respect to the face center plane 140. The angled toe surface 147 may be symmetrical with the angled heel surface 148 about the face center plane 140. In a preferred embodiment, the angle β is the same for the angled toe surface 147 and the angled heel surface 148. Preferably, the angle β is less than the angle θ of the first angled surface 141, the second angled surface 142, the third angled surface 143, the fourth angled surface 144, the fifth angled surface 145, and the sixth angled surface 146. A plane 157 extending along the angled toe surface 147 intersects the face center plane 140 a distance D1 from the striking face 114. A plane 158 extending along the angled heel surface 148 intersects the face center plane 140 at the distance D1 from the striking face 114. In one embodiment, the distance D1 is between 2 inches and 30 inches, more preferably the distance D1 is between 3 inches and 15 inches, and most preferably the distance D1 is between 4 inches and 8 inches. The angled toe surface 147 and the angled heel surface 148 help a golfer align the putter 100 toward an aiming point just in front of the putter 100 along the face center plane 140 to aid the golfer in initiating the golf ball on an intended target line.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus, the present invention should not be limited by the above-described exemplary embodiments but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

Other than in the operating examples, or unless otherwise expressly specified, all of the numerical ranges, amounts, values, and percentages may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A putter comprising:

a first body member including a striking face and a rear portion extending rearward from said striking face;

a face center plane which passes through a face center of said striking face and is perpendicular to a ground plane in an address position;

a second body member coupled to said first body member below said rear portion of said first body member and rearward of said striking face in said address position; and a third body member coupled to said second body member below said second body member in said address position, wherein said first body member includes a first angled surface toeward of said face center plane having an angle between 20 degrees and 60 degrees relative to said face center plane, wherein said third body member includes a second angled surface toeward of said face center plane having an angle relative to said face center plane, wherein said second angled surface is substantially parallel to said first angled surface.

2. The putter of claim 1, wherein said first angled surface has an angle between 30 degrees and 40 degrees relative to said face center plane.

3. The putter of claim 1, wherein said first body member includes an angled toe surface having an angle relative to said face center plane, wherein a plane extending along said angled toe surface intersects said face center plane a distance between 3 inches and 30 inches forward of said striking face.

4. The putter of claim 3, wherein said plane extending along said angled toe surface intersects said face center plane a distance between 4 inches and 8 inches forward of said striking face.

5. The putter of claim 3, wherein said first body member includes an angled heel surface having an angle relative to said face center plane, wherein a plane extending along said angled heel surface intersects said face center plane a distance between 3 inches and 30 inches forward of said striking face.

6. The putter of claim 1, wherein said third body member includes a third angled surface toeward of said face center plane having an angle relative to said face center plane, wherein said third angled surface is substantially parallel to said first angled surface.

7. The putter of claim 6, wherein said first body member includes a fourth angled surface heelward of said face center plane having an angle relative to said face center plane, said fourth angled surface being symmetrical with said first angled surface about said face center plane, wherein said third body member includes a fifth angled surface heelward of said face center plane having an angle relative to said face center plane, said fifth angled surface being symmetrical with said second angled surface about said face center plane, and wherein said third body member includes a sixth angled surface heelward of said face center plane having an angle relative to said face center plane, said sixth angled surface being symmetrical with said third angled surface about said face center plane.

8. The putter of claim 7, wherein said first angled surface has an angle between 30 degrees and 40 degrees relative to said face center plane.

9. A putter comprising:

a first body member including a striking face and a rear portion extending rearward from said striking face; and a face center plane which passes through a face center of said striking face and is perpendicular to a ground plane in an address position, wherein said first body member includes a first angled surface toeward of said face center plane having an angle between 20 degrees and 60 degrees relative to said face center plane, wherein a plane extending along said first angled surface intersects said striking face within +/−0.5 inches from said face center in a heel-to-toe direction.

10. A putter comprising:

a first body member including a striking face and a rear portion extending rearward from said striking face; and a face center plane which passes through a face center of said striking face and is perpendicular to a ground plane in an address position, wherein said first body member includes an angled toe surface having an angle relative to said face center plane, wherein a plane extending along said angled toe surface intersects said face center plane a distance between 3 inches and 30 inches forward of said striking face, wherein said first body member includes a first angled surface toeward of said face center plane, wherein a plane extending along said first angled surface intersects said striking face within +/−0.5 inches from said face center in a heel-to-toe direction.

11. The putter of claim 10, wherein said plane extending along said angled toe surface intersects said face center plane a distance between 4 inches and 8 inches forward of said striking face.

12. The putter of claim 10, wherein said first body member includes an angled heel surface having an angle relative to said face center plane, wherein a plane extending along said angled heel surface intersects said face center plane a distance between 3 inches and 30 inches forward of said striking face.

13. The putter of claim 12, wherein said angled heel surface is symmetrical with said angled toe surface about said face center plane.

14. The putter of claim 13, wherein said first angled surface has an angle between 30 degrees and 40 degrees relative to said face center plane.

15. The putter of claim 10, further comprising:

a second body member coupled to said first body member below said rear portion of said first body member and rearward of said striking face in said address position; and a third body member coupled to said second body member below said second body member in said address position, wherein said third body member includes a second angled surface toeward of said face center plane having an angle relative to said face center plane, wherein said second angled surface is substantially parallel to said first angled surface, wherein said third body member includes a third angled surface toeward of said face center plane having an angle relative to said face center plane, and wherein said third angled surface is substantially parallel to said first angled surface.

16. The putter of claim 15, wherein said first body member, said second body member, and said third body member are visible to a golfer in said address position.

17. The putter of claim 16, wherein said first body member comprises a color which contrasts with a color of said second body member, and wherein said color of said second body member contrasts with a color of said third body member.

18. The putter of claim 17, wherein said rear portion of said first body member comprises an upper surface having at least one sightline, wherein said second body member comprises a top surface having sightlines parallel to each other and spaced equidistant from said face center plane, and wherein said sightlines on said second body member are located a distance greater than 0.1 inches below said upper surface of said first body member in a direction perpendicular to said ground plane in said address position.

* * * * *